US005085238A

United States Patent [19]

Baldwin

[11] Patent Number: 5,085,238

[45] Date of Patent: Feb. 4, 1992

[54] VAPOR DEGREASING APPARATUS

[75] Inventor: Ronald S. Baldwin, Shelton, Conn.

[73] Assignee: Branson Ultrasonics Corporation, Danbury, Conn.

[21] Appl. No.: 663,730

[22] Filed: Mar. 4, 1991

[51] Int. Cl.[5] ..... B08B 7/04

[52] U.S. Cl. ..... 134/105; 34/78

[58] Field of Search ..... 134/105, 107, 108, 109; 202/170; 34/72, 73, 74, 77, 78

[56] References Cited

U.S. PATENT DOCUMENTS

| | | | |
|---|---|---|---|
| 1,119,011 | 12/1914 | Grosvenor | 34/78 |
| 3,632,480 | 1/1972 | Surprenant et al. | 134/105 X |
| 4,078,974 | 3/1978 | McCord | 202/170 X |
| 4,389,797 | 1/1983 | Spigarelli et al. | 34/73 |
| 4,860,460 | 8/1989 | Gaudreau et al. | 34/78 X |

OTHER PUBLICATIONS

"Ultrasonics in Industry", E. B. Steinberg, Proceedings of the IEEE, Oct. 1965.

"Ultrasonic Cleaning and Vapor Degreasing" Branson Cleaning Equipment Co.

*Primary Examiner*—Philip R. Coe

*Attorney, Agent, or Firm*—Polster, Lieder, Woodruff & Lucchesi

[57] ABSTRACT

In a vapor degreasing apparatus solvent vapor provided by a boiling sump is subjected to further heating for producing superheated solvent vapor to which a workpiece in the process of being cleaned is exposed. The superheated solvent vapor raises the temperature of the workpiece in order to minimize solvent adhering to the workpiece surface as the workpiece is removed from the apparatus to ambient. Further heating is achieved by heating means interposed in the natural convection flow path of the solvent vapor provided by a boiling sump to a vapor zone area in the degreasing apparatus.

7 Claims, 1 Drawing Sheet

VAPOR DEGREASING APPARATUS

BRIEF SUMMARY OF THE INVENTION

This invention concerns vapor degreasing apparatus used for cleaning and degreasing workpieces by the use of suitable solvents in their liquid and vapor phase state. Typical solvents used for this purpose include 1,1,1 trichloroethane, various Freon solvents, solvents known as HCFC No. 123, HCFC 141B and others. Vapor degreasers, with or without ultrasonic energy sumps, are well known, see for instance "Ultrasonic Cleaning and Vapor Degreasing" (booklet), Branson Ultrasonics Corporation, Danbury, CT, 1980, pp. 41-62, or "Ultrasonics In Industry", E.B. Steinberg, Proceedings of the IEEE, vol. 53, No. 10, Oct. 1965, page 1299.

A typical vapor degreasing apparatus comprises a first boiling sump chamber in which heating means cause a liquid solvent to be changed to its vapor state. A second chamber disposed above the first chamber and in communication with the first chamber includes a vapor zone area into which the solvent vapor from the first chamber flows responsive to natural convection. The second chamber also includes condensing means above the vapor zone area for condensing the solvent vapor, i.e. returning the solvent to its liquid state. A third chamber, generally known as immersion sump, disposed below the second chamber and adjacent to the first chamber receives the condensed liquid solvent from the second chamber. As the immersion sump fills with liquid solvent, its overflow is fed to the first chamber, the boiling sump, thus restarting the cycle.

A workpiece to be cleaned is held first in the vapor zone of the second chamber for being wetted and receiving a prerinse, is then immersed in the liquid sump for a rinse, is then returned to the vapor zone of the second chamber for receiving a post-rinse, and subsequently is returned to ambient. The liquid sump, optionally may include ultrasonic energy agitation. As the workpiece is returned to ambient, a certain amount of liquid solvent adheres to its surface despite of the presence of the vapor condensing area disposed directly above the vapor zone. The escape of solvent into the ambient atmosphere, of course, is undesirable at it constitutes a monetary loss and, moreover, causes contamination of the ambient atmosphere.

The loss of solvent to the atmosphere can be reduced by heating the solvent vapor disposed in the vapor zone to a superheated state. This causes the workpiece to be heated to a temperature at which the adhering surface film of solvent is largely eliminated. At the present time two major arrangements for bringing the solvent to a superheated state are used. One arrangement comprises a heating coil disposed above the immersion sump which superheats the solvent vapor by natural convection. The other arrangement comprises an externally disposed heat exchanger and a fan for forcing the solvent vapor through the heat exchanger. Both arrangements are not particularly efficient.

The improvement comprehended by the present invention comprises heating means, such as a heat exchanger, disposed in the first chamber for causing all vaporized solvent from the boiling sump to pass over such heating means as the solvent in its vapor state, responsive to convection, flows into the vapor zone area of the second chamber. This arrangement provides for a more uniform heating of the solvent vapor, and effects heating of the solvent vapor at the area where such heating is most effective, i.e. before entering the vapor zone. Typical heating means comprise a heat exchanger fed with hot water, steam or hot oil, or electric heating means.

One of the principal objects of this invention, therefore, is the provision of a new and improved vapor degreasing apparatus.

Another important object of this invention is the provision of a new and improved vapor degreasing apparatus which includes means for reducing the loss of solvent adhering to the workpiece surface when such workpiece after degreasing in the apparatus is withdrawn to ambient.

Another important object of this invention is the provision of a vapor degreasing apparatus including means for bringing solvent vapor to a superheated state using a simple and effective arrangement.

A further important object of this invention is the provision of a vapor degreasing apparatus which includes heat exchange means disposed in the chamber having the boiling sump for causing solvent vapor emanating from the boiling sump to become superheated before it reaches by natural convection flow a vapor zone in a second chamber in communication with the first chamber.

Further and still other objects of this invention will become more clearly apparent from the following description when taken in conjunction with the accompanying drawings.

DETAILED DESCRIPTION OF THE INVENTION

Figure 1:
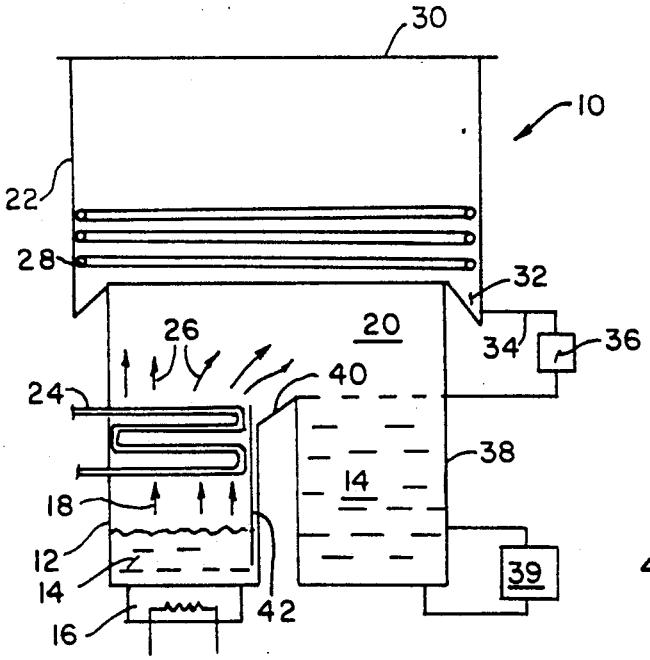
FIG. 1 is a schematic vertical view of a vapor degreasing apparatus incorporating the invention.

Referring now to the figures and FIG. 1 in particular, there is shown schematically a typical vapor degreasing apparatus 10 having a first chamber 12 comprising a boiling sump. Liquid solvent 14 contained in the chamber is brought to its vapor state by suitable heating means 16, such an electrical heating element attached to the underside of the chamber. The resulting solvent vapor having attained it saturated state rises by convection, arrows 18, toward the vapor zone area 20 of a second chamber 22. Before the solvent vapor enters the chamber 22, it is exposed to a second heating means 24, such as heating tubes, disposed in the first chamber 12. The second heating means 24 causes the solvent vapor to become superheated, i.e. attaining a temperature above the boiling point of the solvent. The superheated solvent vapor, arrows 26, then enters the vapor zone area 20 of the second chamber 22. The second chamber 22, in the conventional manner, includes condensing means 28 for returning solvent vapor to its liquid state in order to recycle the solvent and to prevent its escape to ambient when the cover 30 is lifted for cleaning and degreasing workpieces.

Condensed solvent is collected in a peripheral trough 32 which is connected by suitable piping 34 to a water separator 36 from which the liquid solvent is fed to a third chamber 38 which fills with liquid solvent 14 to form an immersion sump or rinse sump. As the level of the solvent in the sump rises, it overflows the weir 40, thus supplying liquid solvent to the first chamber 12 for replenishing the boiling sump. A circulation pump and filter 39 are provided to maintain the solvent in a clean condition.

Importantly, there is disposed in the first chamber 12 a baffle means 42, suitably shaped, to prevent solvent in its still liquid state supplied from the immersion sump from becoming exposed to the second heating means 24 before reaching its vapor state responsive to being acted upon by the first heating means 16. Moreover, the baffle means 42 is provided for guiding solvent vapor produced by the first heating means 24, i.e. solvent vapor in its saturated state, toward the second heating means 24 where the solvent vapor becomes superheated as the vapor, responsive to convection, flows toward the vapor zone area 20.

A workpiece to be cleaned and degreased is first suspended in the vapor zone area 20 for being wetted and subjected to a pre-rinse. Then it is lowered into the immersion sump which may or may not include ultrasonic energy agitation means (not shown). Subsequently, the workpiece is raised and returned to the vapor zone area 20 for a post-rinse and where the workpiece on account of being exposed to superheated vapor attains a temperature which minimizes the adherence of liquid solvent to the workpiece surface as the workpiece is lifted and returned to ambient.

Figure 2:
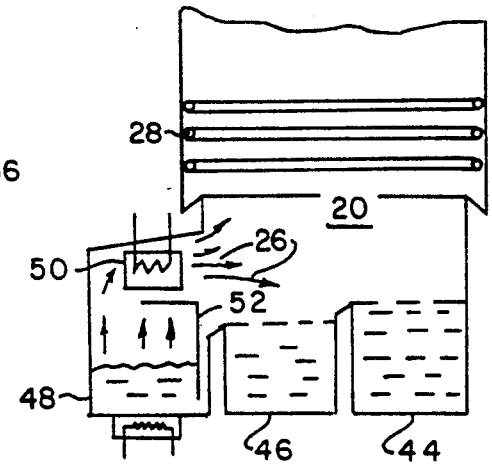
FIG. 2 is a schematic vertical view of another vapor degreasing apparatus also incorporating the invention.

FIG. 2 depicts a vapor degreasing apparatus similar to the embodiment shown in FIG. 1, except that there are provided two immersion sumps, chambers 44, 46. The first chamber 48 comprising the boiling sump is disposed laterally. The second heating means 50 for raising the solvent vapor to a superheated state comprises electrical heating means. The electrical heating elements, for example, are mounted within suitable protective sheaths, properly spaced to accommodate the vapor flow therethrough. The baffle 52 is shaped for guiding the vapor flow from the boiling sump through the superheating means prior to entering the vapor zone area.

Figure 3:
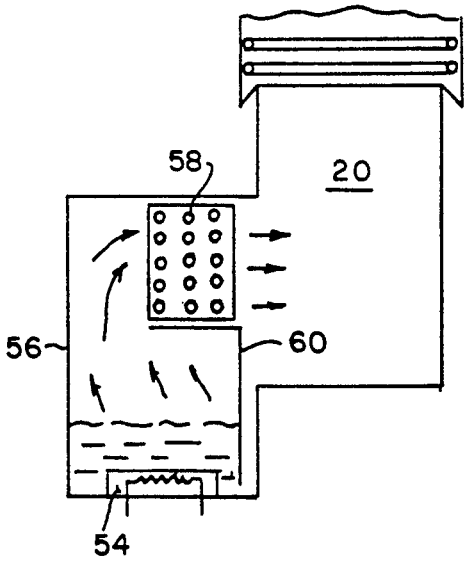
FIG. 3 is a schematic vertical view of still another vapor degreasing apparatus incorporating the invention.

FIG. 3 shows a further embodiment of a vapor degreasing apparatus. It omits the immersion sump. The heating means 54 of the boiling sump is disposed inside the first chamber 56. The second heating means 58 for causing the solvent vapor to become superheated comprises a packaged tube heat exchanger assembly. As explained above, a suitably shaped baffle 60 is disposed to guide the convection flow of solvent vapor provided by the heating means 54 toward and through the additional heating means 58.

In a typical example, using solvent Freon TF having a boiling point of 118° F. (48° C.) and using copper tubing for the second heater fed with steam at 212° F. (100° C.) at atmospheric pressure, the solvent vapor exiting from the second heater attained a temperature of 130° F. (54 5° C.), hence being in a superheated state.

As will be noted from the above description, the improvement achieved by the present invention resides in the arrangement wherein an additional heating means for causing saturated solvent vapor to attain a superheated state is disposed within the vapor degreasing apparatus and interposed in the convection flow path of the solvent vapor from the boiling sump to the vapor zone area. Therefore, the vapor degreasing apparatus disclosed is characterized by a high degree of simplicity and effectiveness.

While there have been described and illustrated several preferred embodiments of the invention, it will be understood by those skilled in the art that various further changes and modifications may be made without departing from the broad principle of this invention, which shall be limited only by the scope of the appended claims.

What is claimed is:

1. In a vapor degreasing apparatus the combination of a first chamber comprising a boiling sump having first heating means for raising the temperature of a liquid solvent contained therein to its boiling point for providing solvent in its vapor state; a second chamber communicating with said first chamber for receiving the solvent in its vapor state in a vapor zone area and including condensing means disposed above the vapor zone area for condensing the solvent and returning it to its liquid state, and means for returning the liquid state solvent from said second chamber to said first chamber, the improvement comprising second heating means disposed for raising the temperature of the vapor state solvent in said first chamber to a superheated state before the vapor state solvent responsive to convection flow is received in the vapor zone area of said second chamber.

2. In a vapor degreasing apparatus as set forth in claim 1, said second heating means being disposed in said first chamber and interposed in the convection flow path of the vapor state solvent from said first chamber to said second chamber.

3. In a vapor degreasing apparatus as set forth in claim 2, said second heating means comprising a heat exchange means.

4. In a vapor degreasing apparatus as set forth in claim 3, said heat exchange means comprising a heated fluid filled pipe.

5. In a vapor degreasing apparatus as set forth in claim 2, said second heating means comprising electrical heating means.

6. In a vapor degreasing apparatus as set forth in claim 2, and baffle means disposed in said first chamber for preventing liquid state solvent returned to said first chamber from contacting said second heating means.

7. In a vapor degreasing apparatus as set forth in claim 2, and baffle means disposed in said first chamber for preventing liquid state solvent returned to said first chamber from contacting said second heating means and for guiding solvent brought to its vapor state by said first heating means to flow past said second heating means.

* * * * *